US005819785A

United States Patent [19]

Bardini

[11] Patent Number: 5,819,785

[45] Date of Patent: Oct. 13, 1998

[54] INSTANTANEOUS HOT WATER CONTROL DEVICE

[76] Inventor: Armando John Bardini, 12033 Hanley Dr., Grass Valley, Calif. 95949

[21] Appl. No.: 845,259

[22] Filed: Apr. 22, 1997

[51] Int. Cl.[6] ..... F16K 49/00

[52] U.S. Cl. ..... 137/337; 126/362; 137/512.15; 137/533

[58] Field of Search ..... 137/532, 337, 137/533, 512.15; 126/362

[56] References Cited

U.S. PATENT DOCUMENTS

| | | | |
|---|---|---|---|
| 1,351,779 | 9/1920 | Mather . | |
| 2,830,612 | 4/1958 | Taylor | 137/337 |
| 2,842,155 | 7/1958 | Peters | 137/337 |
| 4,331,292 | 5/1982 | Zimmer | 137/337 |
| 4,518,007 | 5/1985 | Haws | 126/362 |
| 4,633,853 | 1/1987 | Prill et al. | 126/362 |
| 5,261,443 | 11/1993 | Walsh | 137/337 |
| 5,277,219 | 1/1994 | Lund | 137/337 |
| 5,323,803 | 6/1994 | Blumenauer | 137/337 |
| 5,331,996 | 7/1994 | Ziehm | 137/337 |
| 5,452,740 | 9/1995 | Bowman | 137/337 |

*Primary Examiner*—A. Michael Chambers

*Attorney, Agent, or Firm*—Armando John Bardini

[57] ABSTRACT

A convective flow control device that can maintain hot water at hot water pipe connections at remotely located faucets in homes and buildings. The convective flow device has a two part housing that encloses a dual purpose poppet in an internal circular bored chamber formed by the two piece housing. The said internal circular bored chamber has one or more fluid passageways that communicate with the hot and cold water end of the device, thereby providing for a flow path from the hot water connection to the cold water connection. The said dual purpose poppet has a cylindrical shape, and slides within the internal circular chamber to make contact with the cold water end of the housing, or to make contact with the hot water end of the housing in response to the direction of flow through the device. The dual purpose poppet has a flat side that can prevent flow through the device by closing off the said fluid passageways, in response to flow from the cold water end of the device, and an orifice through the center of the dual purpose poppet controls the convective flow rate through the device from the hot water end of the device. The said orifice drilled through the dual purpose poppet has a different shape at each end which predetermines the resistance to flow from each end of the device, thereby providing low resistance to convective flow from the hot water connection, and high resistance to flow from the cold water connection.

6 Claims, 5 Drawing Sheets

RESISTANCE COEFFICIENTS (K) FOR ORIFICE ENTRANCE CONDITIONS

FLUSH

K, SEE TABLE

| r/d | K |
|---|---|
| 0.00 | 0.50 |
| 0.02 | 0.28 |
| 0.04 | 0.24 |
| 0.06 | 0.15 |
| 0.10 | 0.09 |
| 0.15&UP | 0.04 |

INWARD PROJECTING $K_2=0.78$

INSTANTANEOUS HOT WATER CONTROL DEVICE

BACKGROUND OF THE INVENTION

A number of systems have been devised that will provide an instantaneous supply of hot water at plumbing fixtures. The purpose of these systems is the conservation water and the elimination of the inconvenience of opening a faucet and allowing the water to run down the drain until the hot water reaches the faucet. The amount of water wasted in this way has been estimated to be on the order of 5,000 to 9,000 gallons per household per year. In addition to the water wasted, we must add the cost of heating the cold water that is replaced in the hot water heater.

In order to have instantaneous hot water at the faucets, it is necessary that the heat loss to the ambient air from the hot water pipes be replaced, if hot water is to be continually present at the faucets. Therefore, any device or system designed to provide instantaneous hot water must not add any more heat to the piping system than the amount of heat loss to the ambient air. If this heat balance is maintained, the savings in the cost of water conserved and the cost of heating the water wasted will more than offset the cost of maintaining the temperature of the water in the hot water pipes and, in addition, will provide the convenience of having instantaneous hot water at the plumbing fixtures.

The objective of this invention is to provide a simple, low-cost device that can be installed in new domestic hot water piping systems or easily retrofitted to existing piping systems of residences or small commercial buildings, and incorporated as an integral part of faucets. Another and principal objective of this invention is to control the hot water circulation in order that the said heat balance will be maintained and thereby ensure that energy is not wasted.

SUMMARY OF THE INVENTION

This invention relates to a device designed to provide instantaneous hot water at a faucet or plumbing fixture without the need of a hot water circulation pump or modifications to the existing piping in a building.

The circulation of water through the device that forms the basis of this invention is due to natural convective flow resulting from the temperature gradient between the hot and cold water side of the piping system. The device is connected across the hot and cold water pipes under sinks and fixtures or incorporated as an integral part of faucets and circulation is from the hot water pipe, through the device , and back to the hot water heater through the cold water pipe. The rise in temperature in the cold water pipe is negligible because heat is dissipated to the ambient air through the wall of the exposed interconnecting tube between the device and the cold water pipe connection The said convective flow takes place through the device as a result of the higher temperature water on the hot water side of the device. The higher vapor pressure on the hot water side of the device unseats the poppet valve and circulation through the device takes place. The rate of flow from the hot water pipe to the cold water pipe is predetermined by the shape and size of an orifice incorporated in a poppet valve, which is positioned in the cavity formed by the two piece housing comprising the said convective flow device. The said poppet valve in addition to controlling the rate of flow of hot water through the device, also prevents back flow from the cold water connection to the hot water connection. The pressure drop and resulting force available to move the poppet valve into reverse flow closure is similarly predetermined by the shape of the orifice presented to the fluid in the reverse direction of flow.

The coefficient of resistance to flow in the direction of connective flow from the hot water pipe to the cold water pipe, is designed to be considerably lower than that in the reverse flow direction by a factor of ten or better. This design configuration results in a poppet valve which is highly responsive to pressure increases on the cold water side of the device, thereby insuring closure in response to flow from the cold water pipe to the hot water pipe. It has been found that reverse flow from the cold water line occurs when ever a faucet or other appliance, such as a washing machine is drawing water at another point in the piping system. This reverse flow of cold water, will displace the hot water that is maintained at the hot water pipe, if the reverse flow closure is not accomplished the effectiveness of the device is reduced.

The poppet is made of a material density approximately equal to the density of the fluid medium, which in this case is the density of water. Along with the neutral buoyancy of the poppet, the mass of the device must be minimized to insure that a very small pressure differences across the poppet will overcome its inertia, and thereby maximize the sensitivity and responsiveness of the poppet.

DISCUSSION OF THE PRIOR ARTS

A number of systems have been devised to provide instant hot water to remote faucets or plumbing fixtures in buildings. The reason that these systems are not more often applied to residences and buildings is that the cost of installation or retrofitting cannot be justified.

These prior arts systems fall into three general categories:

(1) A three pipe systems with a dedicated circulation pump.

(2) Localized heating arrangements.

(3) Convective flow devices utilizing the hot and cold water lines for circulation of hot water.

The reference patents cited in this application fall in all three of these categories, but only the patents utilizing convective flow and that have particular relevance to this application will be discussed here.

In U.S. Pat. No. 4,331,292 to Zimmer is a device that is connected across hot and cold water pipes and the convective flow rate is controlled by a bimetal element which opens and closes a port in response to temperature. Reverse flow from the cold water pipe to the hot water pipe is prevented by a ball check valve. This is a relatively simple device but the responsiveness the ball check valve may be a problem.

In U.S. Pat. No. 5,323,803 to Blumenauer is a convective flow device utilizing a manually adjustable orifice in the form of gate valve which establishes the convective flow rate and a ball check valve which prevents reverse flow. The anticipated problems with this device is the difficulty of adjusting the flow rate and also the responsiveness of the ball check valve.

In U.S. Pat. No. 2,842,155 to Peters is another design configuration which employs a valve which is activated by temperature responsive element to control the convective flow rate through the device. A ball check valve prevents reverse flow. Again as in the above prior arts seating the ball check valve is a problem.

In U.S. Pat. No. 5,331,996 to Ziehm which utilizes a buoyant poppet type check valve to insure that the check valve will float off its closure seat if positioned at angle with the horizontal.

The buoyant poppet check valve will float open and insure connective flow, but difficulty in accomplishing reverse flow closure can be encountered, since the reverse flow resistance is approximately equal in both directions of flow. Therefore, the sensitivity to reverse flow is limited. This is the case with ball check valves and the other poppet type check valves.

In the above prior arts the convective flow rate is controlled by either a temperature sensing element or a manually adjusted valve. It has been found that in convective flow applications, which is the subject of this patent application, a predetermined orifice size will provide the required flow rate or heat migration control required to maintain hot water at a plumbing fixture. It also has been determined that a ball type or plunger type lift check valve will not respond well to gradual or low velocity reverse flow rates. In the reference patent to Ziehm a low density material is used, which obviously will improve the sensitivity of the check valve, but the coefficient of flow resistance through the annular passageways in both directions of flow are very close to equal. Therefore, the responsiveness of this check valve configuration is of little improvement over a low density ball check.

The device that is the subject of this patent application differs structurally from the prior arts in the following aspects:

(a) A two piece housing with connecting means at opposite ends for attachment to hot and cold water conduits.

(b) A flow control orifice poppet combination configured to control flow in one direction and prevents flow in the opposite direction.

(c) An orifice centered in a cylindrical poppet and shaped to provide high fluid resistance in one direction of flow and low resistance in the opposite direction of flow.

DETAILED DESCRIPTION OF THE INVENTION

Figure 1:
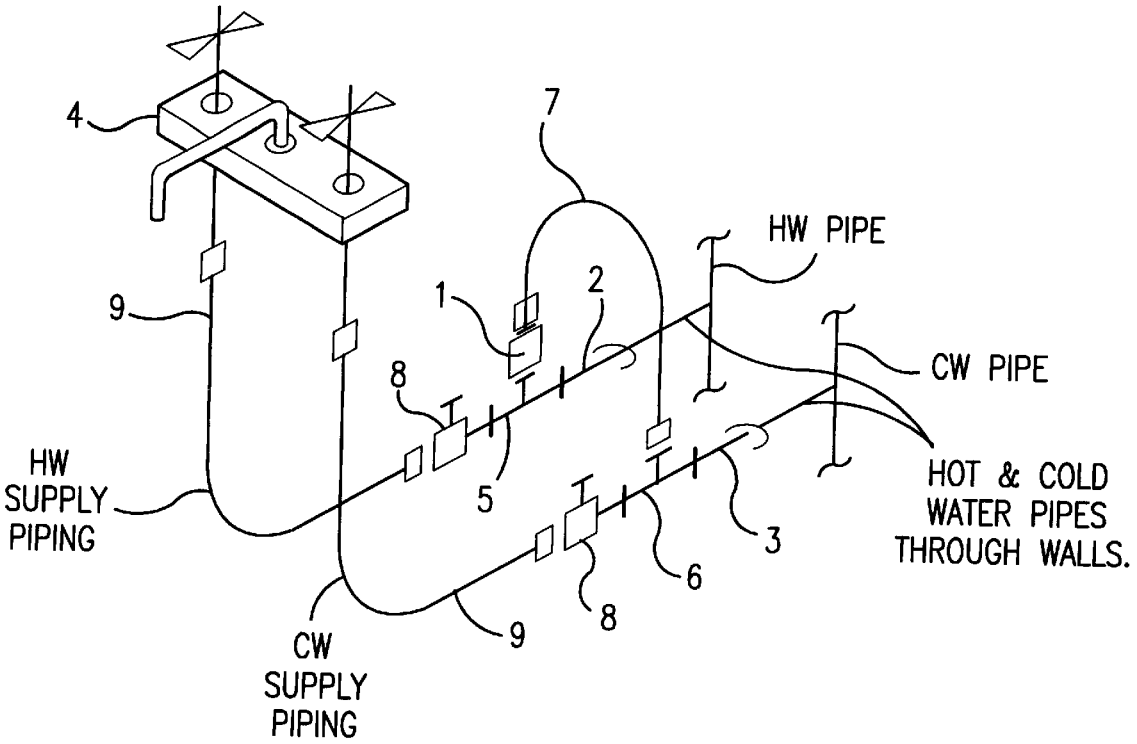
FIG. 1 is a schematic drawing showing how the device designated by the numeral 1 ,which is the basis of this application, can be connected to the hot and cold water pipes under sinks and basins.

Referring to FIG. 1, the instantaneous hot water device, designated by the numeral 1, is connected between the hot water pipe (2), and the cold water pipe (3) serving a sink faucet (4). A convective flow path is established between the hot water pipe (2) through the use of a tee fitting (5) attached to the hot water pipe (2). One end of the device is screwed into the said tee fitting (5). One end of an interconnecting flexible tube assembly(7) is connected to the opposite end of the device (1), and the other end of the flexible tube assembly (7) is connected to the second tee fitting (6) on the cold water pipe (3), completing the said convective flow path. The device (1) is shown installed upstream of existing shut-off valves (8) and the existing connecting tubing (9). to the sink faucet (4). The device has threads (10) and (11)at each end of the device (1), thereby providing connecting means to pipe fittings and plumbing fixtures.

Figure 2:
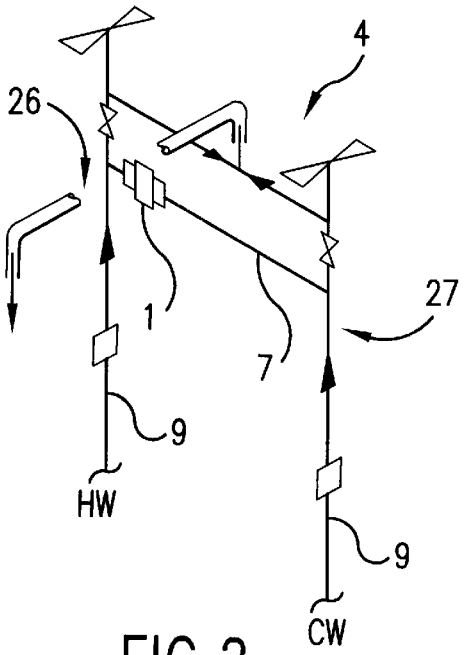
FIG. 2 is a schematic drawing showing the device incorporated as an integral part of of conventional hot and cold water faucet.

Referring to FIG. 2 the instantaneous hot water control device (1) is incorporated in a conventional valve by interconnecting the hot water connection (26) and the cold water connection (27).

Figure 3:
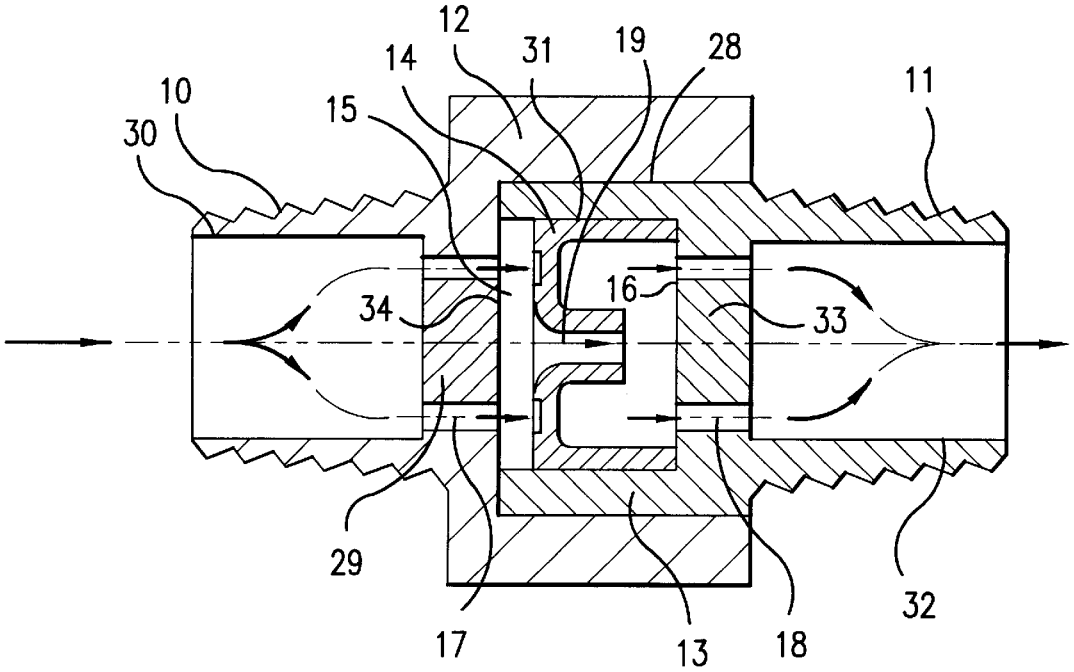
FIG. 3 is a sectional drawing of the said device showing the assembly of the three parts comprising the device with flow path from the hot water end of the device to the cold water end of the device.
Figure 4:
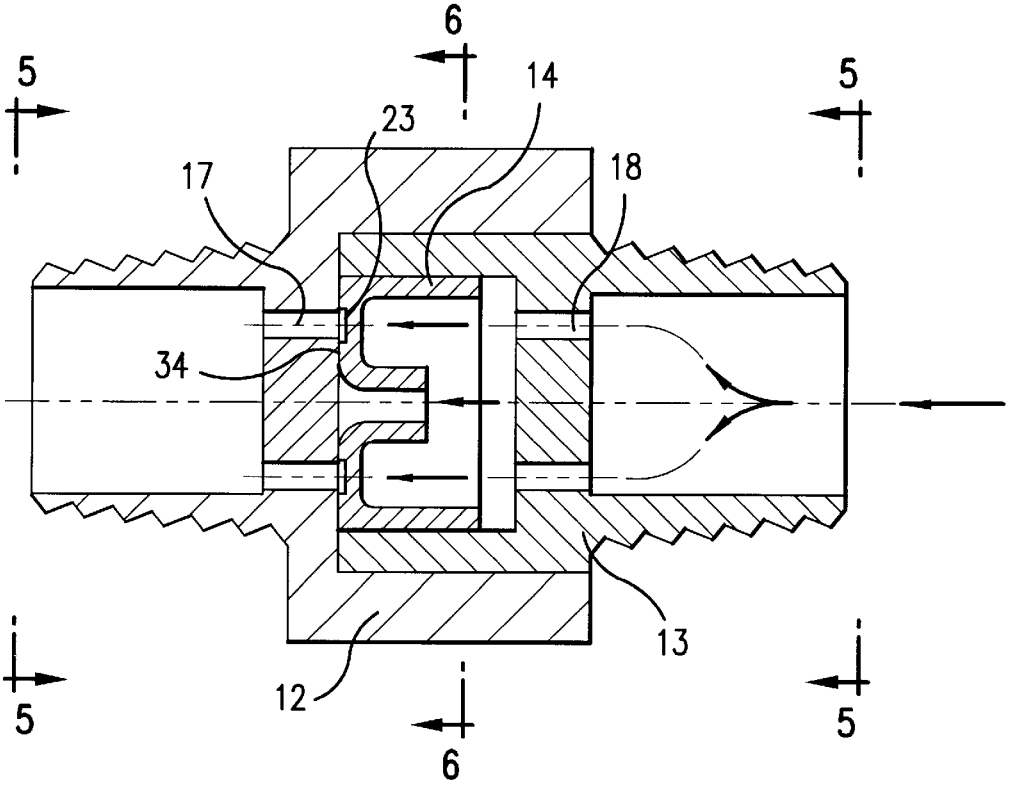
FIG. 4 is a sectional drawing of said device showing the flow path from the cold water end of the device to the hot water end of the device.
Figure 5:
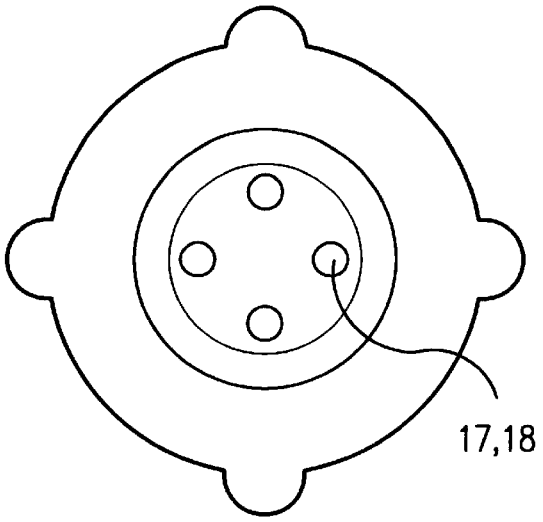
FIG. 5 is a view of both the hot water (HW) end and the (CW)end of the device showing entrance and exit passageways to the inner chamber formed by the assembly of the two piece housing.
Figure 6:
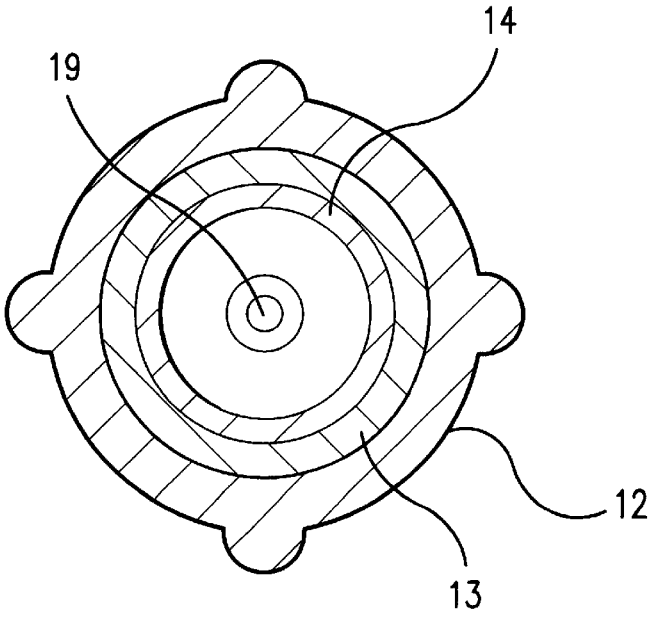
FIG. 6 is a sectional view through the said inner chamber of the assembled device, showing a view of the poppet face and the exit end of the orifice therein.

Referring to FIG. 3 and 4 the device 1 is comprised of three principle parts; a hot water inlet housing (12), a cold water outlet housing (13) and a poppet (14).When the cold water outlet housing (13) is slip fitted and bonded into bore (28) hot water inlet housing (12), a chamber (15) is formed which houses the said poppet (14). The poppet (14) slides freely from end to end within the chamber (15) in respose to pressure differences across the the instantaneous control device (1).

The hot water inlet housing (12) has blind ended bores (30) and (28) bored from both ends of the housing (12) thereby forming a solid section or fluid barrier (29). Likewise the cold water outlet housing (13) has blind ended bores (31) and (32) from both ends of the housing (13) thereby forming a solid fluid barrier (33). The said fluid barriers have drilled passageways (17) and (18) in the outer periphery of their respective bores (30) and (32) thereby communicating with the said chamber (15).

Referring to FIG. 3 the poppet (14) which slides in the inner bore (31) of the cold water outlet housing (13), is shown forced by the vapor pressure of the heated water against the face (16) of the inner bore (31) of the outlet housing (13). This results in an open flow path from the hot water end of the instantaneous hot water device (1), through the drilled passageways (17), the orifice (19) in the poppet (14), and through the passageways (18) into the cold water end of the instantaneous hot water device (1).

Figure 7A:
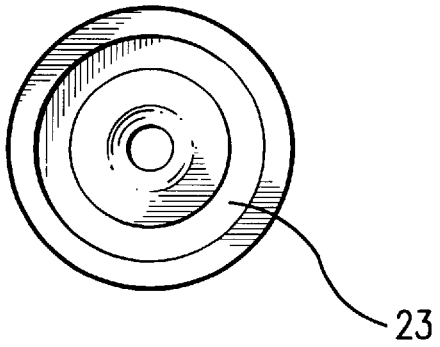
FIG. 7 is a sectional view of the poppet and the orifice configuration.
Figure 7B:
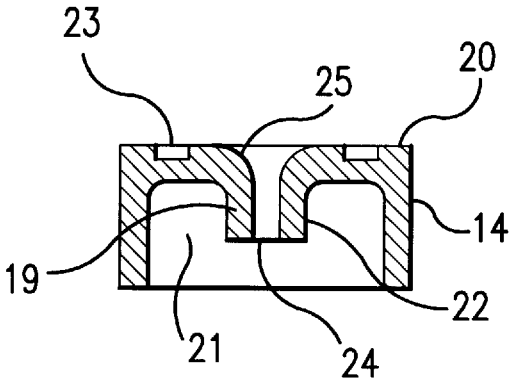

Referring to FIG. 7 the poppet (14) has a circular shape with one flat face (20) and the opposing face having a bored cavity (21) around an elongated central circular portion (22). The orifice (19) is drilled through the cental axis of the said circular shaped poppet. An annular groove (23) on the flat face (20) of poppet align with the drilled passageways (17) in the hot water inlet housing (12). This annular groove increases the area that the fluid pressure acts upon, thereby providing the pressure force necessary to unseat the poppet (14). The orifice (19) has a bell mouth formed by a radius (25) on the said flat face (20) of the poppet (14), and a sharp edge opening (24) at the other end of the orifice opening ( 19) passing through the said elongated central portion (22). This configuration provides for a different coefficient of flow resistance in each direction of flow through the instantaneous hot water control device (1).

Figure 8:
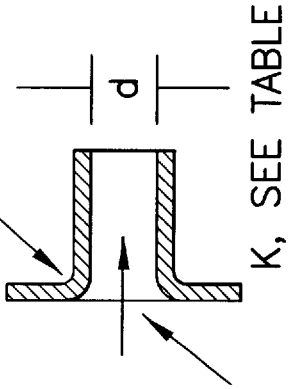
FIG. 8 is a tabulation of flow resistance coefficients (K) for orifice entrance coefficients.
Figure 8:
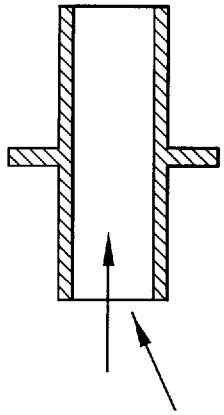

Referring to FIG. 8 the tabulated values of resistance coefficients (K values) range from a K1=0.04 to a K2=0.78 or a flow resistance ratio of 19 to 1 depending on the orifice entrance conditions. This range of K values has proven to be wide enough to provide for the correct hot water convective flow conditions in one direction, and the prevention of cold water back flow through the oposite direction of instantaneous hot water device (1).

It can be seen that the coeffient (K1) can be designed to be considerably lower in value than the resistance coefficient (K2) in the cold water back flow direction . This is accomplished by the bell mouth or radius (25) on orifice (19) entrance on the hot water side of the poppet (14) and the sharp edge orifice exit (24) on the cold water side of the poppet (14).

The above orifice design configuration is necessary because it has been determined that in order to control both the convective flow rate from the hot water connection to the cold water connection, and prevent back flow from the cold water connection to the hot water connection, the resistance coefficients K1 and K2 values must be designed to specific values, so that the resistance in the convective flow direction is lower than the resistance in the back flow direction.

Referring to FIG. 4 it can be seen that in order to move the poppet (14) up against the bore face (34) and closing off the drilled passageways (17), the flow resistance must be as high enough, so that the pressure differential across the orifice (19) is great enough to move the poppet (14) against the bore face (34) and close off the drilled passageways (17) and thereby prevent back flow from the cold water connection.

It is understood that the invention is not limited to the specific embodiment set forth herein but is to be limited only by the scope of the attached claim or claims, including the full range of equivalency to which each element thereof is entitled.

I claim:

1. An instantaneous hot water control device having means for controlling convective flow between hot and cold water pipes or facet connections and thereby maintaing hot water at the hot water connection of said pipes and faucets, comprising:

(a) a two piece housing consisting of a first part (12) and a second part (13) whereby an enclosed inner chamber (15) is formed when the second part (13) is entered into the bore (28) of the first part (12), the said inner chamber (15) being defined at its ends by the inner face (16) of the bore (31) of the second part (13), the inner face (34) of the bore (28) of the first part (12) and circumscribed by the bore (31) of the secound part (13);

(b) a cylindrical poppet (14) installed in the chamber (15) with sliding contact in the bore (31) in the second part (13), said cylindrical poppet (14) having a flat face (20) at one end and the opposite end having a bored cavity (21) circumscribing an elongated circular extension (22) with an orifice (19) drilled through the central axis of the said extension (22) and exiting through the center of the said flat face (20) of the said poppet (14) whereby the said orifice (19) provides means for controlling the rate of flow through the instantaneous hot water control device (1) and the flat face (20) providing means for fluid flow closure.

2. The instantaneous hot water control device (1) according to claim 1, wherein the first part (12) can be further characterized as having a blind bore (30) from one end of the first part (12) and a secound blind bore (28) from the opposite end of the said first part (12) whereby a remaining fluid barrier (29) separates the blind bores (28) and (30), wherein one or more drilled passageways (17) are located on the outer perimeter of the blind bore (30) thereby providing means for fluid passage.

3. The instantaneous hot water control device (1) according to claim 1, wherein the second part (13) can be further characterized as having a blind bore (32) from one end of the said second part (13) whereby a remaining barrier (33) separates the blind bores (31) and (32), wherein one or more drilled passageways (18) are located on the outer perimeter of the blind bore (32) thereby providing means for fluid passage.

4. The instantaneous hot water control device (1) according to claim 1, wherein the poppet (14) can be further characterized as having the orifice (19) that extends through the center of the poppet (14) wherein one end of said orifice (19) has a radius (25) entrance, and the opposite end a sharp edge entrance (24) thereby providing means for establishing the mathematically correct lower flow resistance coefficient in the radius (25) direction of flow, and a mathematically correct higher flow resistance coefficent in the sharp edge (24) direction of flow through the orifice (19).

5. The instantaneous hot water control device (1) according to claim 1 wherein the poppet (14) can be further characterized as having a circular cross section with a flat face (20) on one end thereby providing means for interrupting flow through the instantaneous hot water control device (1) and a centrally drilled orfice (19) perpendicular to said flat face (20) providing means for controlling the flow rate through the instantaneous hot water control device (1).

6. The instantaneous control device (1) according to claim 1 wherein the poppet (14) can be further characterized as having an annular groove(23) in the flat face (20) of the poppet (14) wherein the said groove (23) is annularly positioned about the center of the orifice (19) and located to cooperate with the drilled passageways (17) on the inner face (34) of the first part (12) of the instantaneous hot water control device (1) housing, whereby a greater area is exposed to the hot water vapor pressure and thereby providing means for increasing the force available to unseat the poppet (14).

* * * * *